US011122377B1

(12) United States Patent
Dickmann

(10) Patent No.: US 11,122,377 B1
(45) Date of Patent: Sep. 14, 2021

(54) VOLUME CONTROL FOR EXTERNAL DEVICES AND A HEARING DEVICE

(71) Applicant: Sonova AG, Staefa (CH)

(72) Inventor: Georg Dickmann, Ebmatingen (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/984,186

(22) Filed: Aug. 4, 2020

(51) Int. Cl.
*H04R 25/00* (2006.01)

(52) U.S. Cl.
CPC ..... *H04R 25/558* (2013.01); *H04R 25/356* (2013.01); *H04R 25/502* (2013.01); *H04R 25/70* (2013.01); *H04R 2225/41* (2013.01); *H04R 2225/61* (2013.01)

(58) Field of Classification Search
CPC .. H04R 25/558; H04R 25/356; H04R 25/502; H04R 25/70; H04R 2225/41; H04R 2225/61
USPC ..... 381/315
See application file for complete search history.

(56) References Cited

U.S. PATENT DOCUMENTS

2003/0002698 A1* 1/2003 Ludvigsen ..... H04R 25/70 381/314
2006/0093997 A1* 5/2006 Kearby ..... G09B 21/009 434/185
2008/0298606 A1* 12/2008 Johnson ..... H04R 1/1091 381/74
2010/0041940 A1* 2/2010 Hillbratt ..... H04R 25/606 600/25
2015/0365771 A1* 12/2015 Tehrani ..... B62D 63/00 381/315
2018/0061411 A1* 3/2018 Bhat ..... H04R 25/554

FOREIGN PATENT DOCUMENTS

EP 0917398 A2 5/1999

* cited by examiner

*Primary Examiner* — Sean H Nguyen
(74) *Attorney, Agent, or Firm* — ALG Intellectual Property, LLC

(57) ABSTRACT

The disclosed technology relates to a hearing device that can determine whether a client device is implementing rich and/or simple volume control. Based on if the client device implementing rich and/or simple volume control, the hearing device can locally adjust the volume, levels, or amplification of output signals at the hearing device. In some implementations, the hearing device determines that the client device is implementing a rich volume control, and the hearing device only adjust master volume amplification for output signals of the hearing device. In other implementations, the hearing device determines that the client device is implementing simple volume control and the hearing device adjusts a balance of ambient and external sound levels for the output signal of the hearing device.

20 Claims, 4 Drawing Sheets

VOLUME CONTROL FOR EXTERNAL DEVICES AND A HEARING DEVICE

TECHNICAL FIELD

The disclosed technology generally relates to a hearing device and volume control of the hearing device. More specifically, the disclosed technology relates to a hearing device configured to provide volume control service to simple and rich client devices, where simple devices have limited volume control and rich devices have more complex volume control.

BACKGROUND

Hearing devices provide audio or audio signals to a user wearing the hearing devices. Some example hearing devices include hearing aids, headphones, earphones, assistive listening devices, cochlear devices paired with a cochlear implant, or any combination thereof. Hearing devices include both prescription devices and non-prescription devices configured to be worn on or near a human head.

Hearing device users prefer devices that adjust to everyday listening situations. Specifically, hearing device users prefer devices that can be adapted to a busy coffee shop, a windy park, quiet home, phone call in a loud room, listening to music, or conversation in a loud room. Generally, hearing device users can adjust volume settings directly on the hearing device by moving or adjusting a button, toggle, dial, or switch. Hearing device users can adjust the volume settings to better hear or experience sound.

When a hearing device outputs audio or audio signals, it can provide a balance of ambient sound and external sound. Ambient sound refers to sound that was received or generated locally at the hearing device by a microphone of the hearing device. For example, ambient sound can be wind noise picked up by a hearing device microphone. External sound refers to sound or sound signals received from another device at the hearing device. For example, a mobile phone can transmit audio signals for a phone call to a hearing device, where the hearing device user is using the hearing device to listen to the audio of the phone call, which is considered the external sound.

When a hearing device outputs an audio signal, it can change the volume or amplification of the signal, where the signal includes both external sound and ambient sound. For example, the hearing device can increase the amplification of a combined external sound signal and ambient sound signal. If an output signal includes both external sound and ambient sound, a hearing device user would interpret increasing the volume as everything being louder (e.g., for a windy phone call, the wind noise and the phone call audio would both get louder). Alternatively, if volume or amplification is decreased, a hearing device user would interpret decreasing the volume as everything being softer (e.g., for a windy phone call, the wind noise and the phone call audio signal would both be softer).

Providing an output signal with a volume that is comfortable for the user can be difficult given the variables and constraints of external devices and hearing devices. Accordingly, there exists a need to address the above-mentioned problems and provide additional benefits.

SUMMARY

This summary is provided to introduce a selection of concepts in a simplified form that are further described below in the Detailed Description. This summary is not intended to identify key features of the claimed subject matter. The disclosed technology includes a method (e.g., a computed-implemented method) and a hearing device configured to implement the method. The method can include establishing a wireless communication connection between a hearing device and a client device; providing volume control service for the hearing device to the client device; determining, at the hearing device, whether the client device is implementing rich or simple volume control based on communication with the client device, wherein the rich volume control is associated with an ability of the client device to provide an ambient sound level and an external sound level associated with volume of a hearing device output signal, and wherein the simple volume control is associated with an ability of the client device to adjust only a master volume level associated with the volume of the hearing device output signal; in response to determining the client device is implementing the rich volume control, modifying, only the master volume at the hearing device based on a master volume level provided by the client device; or in response to determining the client device is implementing the simple volume control, modifying a balance of ambient sound and external sound for the hearing device output signal based at least partially on the master volume level provided by the client device.

In some implementations, determining whether the client device is implementing the rich or the simple volume control further comprises determining that the client device is implementing the rich volume control based on determining that the client device has registered for notification of volume state changes for the hearing device, read volume state settings for the hearing device, and/or registered for notification of the ambient sound level and external sound level. Also, determining that the client device is implementing the simple volume control can be based on determining that the client device has not registered for the notification of volume state changes for the hearing device, has not read the volume state settings for the hearing device, and/or has not registered for notification of the ambient sound level and external sound level.

In some implementations, a rich client device may have separate controls to adjust a level of a tinnitus-masking signal (e.g., as generated by a hearing device) as compared to a simple client may just have a signal knob. In a configuration of the hearing device where it was rendering both the tinnitus masking signal and the ambient signal, the hearing device can map the control of a simple client (e.g., 1-dimension of control) to increase ambient sound or increase tinnitus masking. In contrast, a rich client's actions would have the hearing device to just apply what the rich client has requested with respect to tinnitus masking signals and volume settings The method can be implemented by the processor of the hearing device or the method can be stored in the memory of the hearing device.

Figure 1:
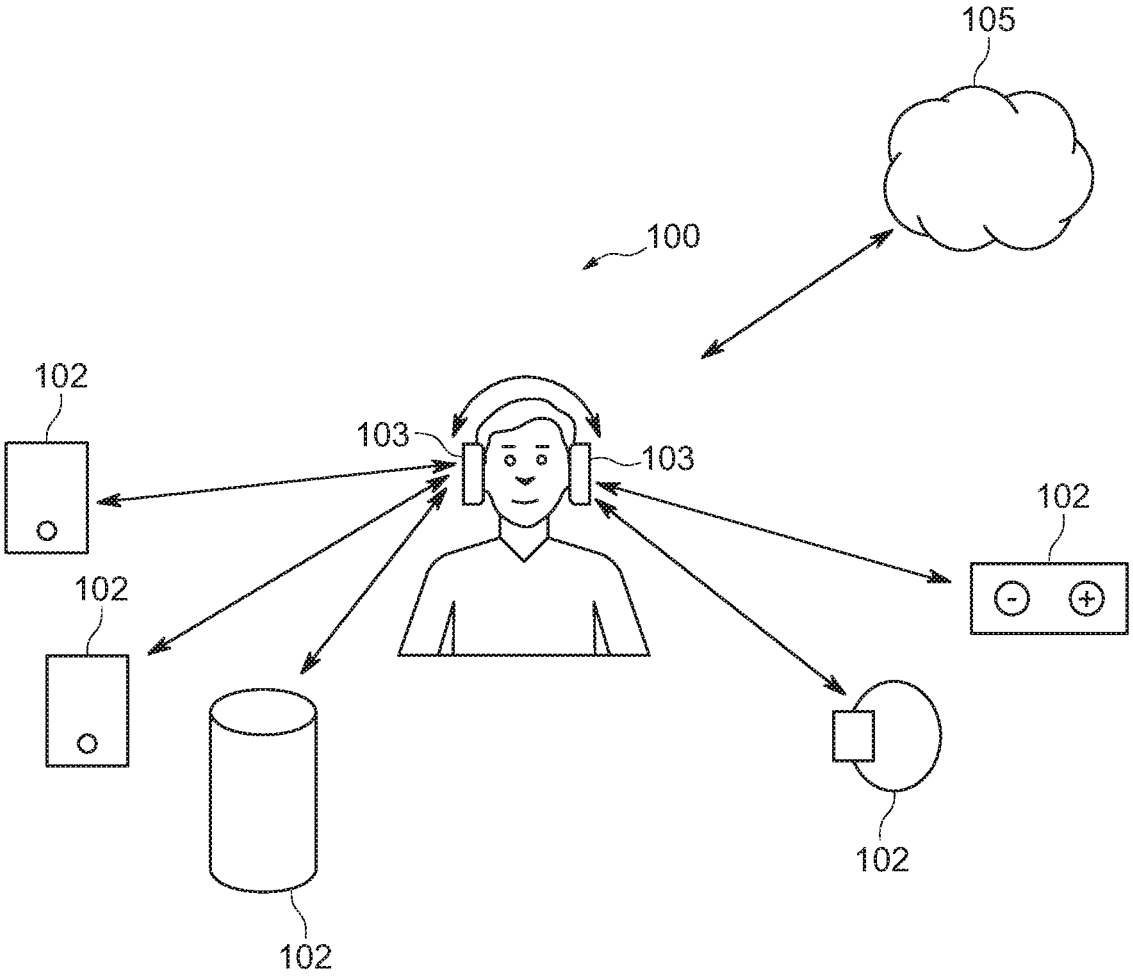
FIG. 1 illustrates a communication environment in accordance with some implementations of the disclosed technology.

The drawings are not to scale. Some components or operations may be separated into different blocks or combined into a single block for the purposes of discussion of some of the disclosed technology. Moreover, while the technology is amenable to various modifications and alternative forms, specific implementations have been shown by way of example in the drawings and are described in detail below. The intention, however, is not to limit the technology to the selected implementations described. On the contrary, the technology is intended to cover all modifications, equivalents, and alternatives falling within the scope of the technology as defined by the appended claims.

DETAILED DESCRIPTION

The disclosed technology relates to a hearing device that can determine whether a client device is implementing rich or simple volume control. If the client device is implementing rich volume control, the hearing device can only locally adjust master volume control (e.g., amplification) of a hearing device output signal (e.g., based on input from a button on local hearing device). In contrast, if the client device is implementing simple volume control, the hearing device can locally adjust the master volume, ambient sound level, and external sound level of the hearing device output signal. More generally, a rich client device knows what to do with respect to volume control, e.g., the hearing device does volume adjustment as requested by the rich client (e.g., exactly the same settings of the rich client). The simple client is less sophisticated in that it can act on master volume only. Therefore, the hearing device interprets the master volume from a simple client device as preferring more or less external signal and/or preferring more or less ambient signal.

An ambient sound level refers to a level, e.g., between 1-10 where 1 refers to 0% or no ambient sound and 10 refers to 100% or maximum ambient sound (e.g., can only hear ambient sound signal). An external sound level refers to a level, e.g., between 1-10 where 1 refers to 0% or no external sound and 10 refers to 100% or maximum external level sound (e.g., can only hear external sound signal). Other numerical values for levels can be used (e.g., 1-100, etc.).

A balance refers to the level of the external sound versus the level of the ambient sound or vice versa. The hearing device can output sound with different balances of ambient sound level and external sound level. For example, the hearing device can output sound in a 50/50 balance, where 50% of the sound output is ambient sound and 50% is external sound. The hearing device can then amplify the output signal, e.g., amplify a signal that has 50% external sound and 50% ambient sound, which causes the user to hear both sounds louder. As another example, the hearing device can output sound with a 60/40 balance or 40/60 balance, where 60% of the sound output is ambient sound and 40% is external sound or 40% of the sound output is ambient sound and 60% is external sound. In the latter example, the hearing device output signal would have a higher signal-to-noise ratio (SNR) for the external signal. Having a higher SNR enables the hearing device to hear a signal more clearly even though the signal was not amplified more. Rather, it is relatively easier to hear the external sound when there is less ambient sound.

In communicating between a wireless communication device and a hearing device regarding volume control, a hearing device can be considered a server because it provides Generic Attribute Profile (GATT) services to client devices (e.g., one or more clients devices). Specifically, the hearing device can provide control of its volume control to client devices such that the client devices can adjust volume settings of the hearing device. Volume control generally includes the settings, programming, and/or hardware that a hearing device uses to adjust the volume of its output signal. With GATT services, a hearing device can provide notification of its volume states or changes of its volume state to client devices.

In some implementations, a rich client device may have separate controls to adjust a level of a tinnitus-masking signal (e.g., as generated by a hearing aid) as compared to a simple client may just have a signal knob. Here, a hearing device would detect the rich client device as being explicitly interested (e.g., by reading/registering for tinnitus or volume settings notifications) in the level of the tinnitus masking signal. In a configuration of the hearing device where it was rendering both the tinnitus masking signal and the ambient signal, the hearing device can map the control of a simple client (e.g., 1-dimension of control) to increase ambient sound or increase tinnitus masking. In contrast, a rich client's actions would have the hearing device to just apply what the rich client has requested with respect to tinnitus masking signals and volume settings.

The disclosed technology has the advantage that volume settings can be improved (e.g., optimized) for a hearing device user. For example, if a hearing user has a simple device that does not offer rich volume control, the hearing device can receive an external signal from that device and handle the rich volume control at the hearing device without feedback or information from the simple device. For example, with a simple volume control client device, the hearing device can convert volume control actions to ambient/balance control locally on the hearing device. Alternatively, if the hearing device user has rich device that is connected to the hearing device and offers rich volume control, the hearing device does not need to further modify the volume settings received from the external device. Rather, the hearing device only needs to increase or decrease (e.g., amplify) For example, with a rich volume control client device, the hearing device can take its request literally, applying individual changes to ambient sound level, external sound level, and total amplification as requested by the rich volume control client.

FIG. 1 illustrates a communication environment 100. The communication environment 100 includes wireless communication devices 102 and hearing devices 103. As shown by double-headed bold arrows in FIG. 1, the wireless devices 102 and the hearing devices 103 can communicate wirelessly, e.g., each wireless communication device 102 can communicate with each hearing device 103. Also, each hearing device 103 can communicate with the other hearing device 103.

In communication environment 100, the hearing device 103 can be considered a server because provides a volume control service to wireless communications devices 102 as client devices. A client device can be any of the wireless communication devices 102. For example, a wireless communication device 102 can be a mobile phone and it can connect with the hearing device 103 via a wireless communication protocol, and then it can use that wireless communication protocol to transmit an external signal to the hearing device. The wireless communication device 102, as a client, can request to receive updates regarding the states of the volume control of the hearing device 103. The wireless communication device 102 can also provide an external sound level, ambient sound level, and/or master volume setting for the hearing device. The hearing device 103 can use that received information in providing its output signal as further described in FIGS. 2, 3, and 4.

A wireless communication protocol can include Bluetooth Basic Rate/Enhanced Data Rate™, Bluetooth Low Energy™, a proprietary communication (e.g., binaural communication protocol between hearing aids, ZigBee™, Wi-Fi™, or an Industry of Electrical and Electronic Engineers (IEEE) wireless communication standard. As part of using a protocol, the hearing device 103 and the wireless communication 102 may perform steps of authentication and establishing a wireless communication connection (e.g., complete a pairing process for Bluetooth Low Energy™).

The wireless communication devices 102 are computing devices that are configured to wirelessly communicate. Wireless communication includes wirelessly transmitting information, wirelessly receiving information, or both. The wireless communication devices 102 shown in FIG. 1 include computers (e.g., desktop or laptop), televisions (TVs) or components in communication with television (e.g., TV streamer), telephone, a car audio system or circuitry within the car, a mobile device (e.g., smartphone or mobile phone), tablet, remote control (e.g., a remote control configured to control volume), an accessory electronic device, a wireless speaker(s), watch, an audio playback device, or other computing device.

Also, the wireless communication devices 102 can have microphones to receive or generate a sound, and this sound can be transmitted to the hearing device 103. The wireless communication device 102 can generate an audio signal in other ways, e.g., providing an audio signal or sound from memory. Audio signals transmitted from the wireless communication 102 to the hearing device are considered external sound signals or external signals because the hearing device did not generate the signal; rather, the hearing device received it from an external device. An external device is any device that is not the hearing device and located external to the hearing device.

The hearing devices 103 are devices that provide audio to a user wearing the hearing devices. Some example hearing devices include hearing aids, headphones, earphones, assistive listening devices, or any combination thereof. Hearing devices include both prescription devices and non-prescription devices configured to be worn on or near a human head. As an example of a hearing device, a hearing aid is a device that provides amplification, attenuation, or frequency modification of audio signals to compensate for hearing loss or attenuation functionalities; some example hearing aids include a Behind-the-Ear (BTE), Receiver-in-the-Canal (RIC), In-the-Ear (ITE), Completely-in-the-Canal (CIC), Invisible-in-the-Canal (IIC) hearing aids or a cochlear implant (where a cochlear implant includes a device part and an implant part).

The hearing devices 103 are configured to binaurally communicate or bimodally communicate. The binaural communication can include a hearing device 103 transmitting information to or receiving information from another hearing device 103. Information can include volume control, signal processing information (e.g., noise reduction, wind canceling, directionality such as beam forming information), or compression information to modify sound fidelity or resolution. Binaural communication can be bidirectional (e.g., between hearing devices) or unidirectional (e.g., one hearing device receiving or streaming information from another hearing device). Bimodal communication is like binaural communication, but bimodal communication includes a cochlear device communicating with a hearing aid.

The network 105 is a communication network. The network 105 enables the hearing devices 103 or the wireless communication devices 102 to communicate with a network or other devices. The network 105 can be a Wi-Fi™ network, a wired network, or e.g. a network implementing any of the Institute of Electrical and Electronic Engineers (IEEE) 802.11 standards. The network 105 can be a single network, multiple networks, or multiple heterogeneous networks, such as one or more border networks, voice networks, broadband networks, service provider networks, Internet Service Provider (ISP) networks, and/or Public Switched Telephone Networks (PSTNs), interconnected via gateways operable to facilitate communications between and among the various networks. In some implementations, the network 105 can include communication networks such as a Global System for Mobile (GSM) mobile communications network, a code/time division multiple access (CDMA/TDMA) mobile communications network, a 3rd, 4th or 5th generation (3G/4G/5G) mobile communications network (e.g., General Packet Radio Service (GPRS)).

Figure 2:
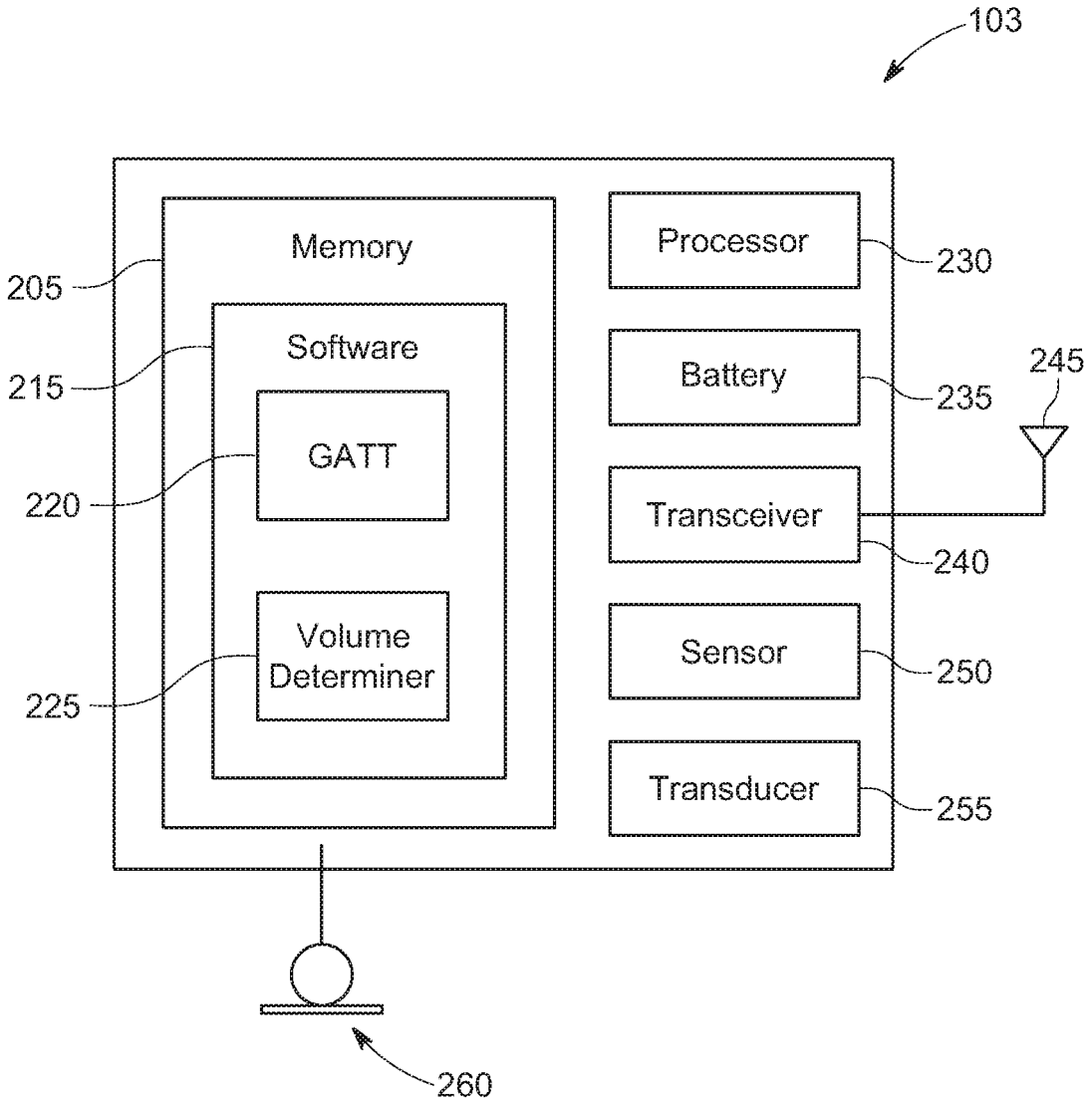
FIG. 2 illustrates a hearing device from FIG. 1 in more detail in accordance with some implementations of the disclosed technology.

FIG. 2 is a block diagram illustrating the hearing device 103 from FIG. 1 in more detail. FIG. 2 illustrates the hearing device 103 with a memory 205, software 215 stored in the memory 205, the software 215 includes a generic attribute profile (GATT) 220 and a volume determiner 225. The hearing device 103 also includes a processor 230, a battery 235, a transceiver 240, an antenna 245, a sensor 250, a transducer 255, and microphone 260.

The software 215 performs certain methods or functions for the hearing device 103 and can include components, subcomponents, or other logical entities that assist with or enable the performance of these methods or functions. Although a single memory 205 is shown in FIG. 2, the hearing device 103 can have multiple memories 205 that are partitioned or separated, where each memory can store different or the same information.

The GATT 220 generally establishes common operations and a framework for data transported and stored in an attribute protocol. The GATT 220 includes the hierarchy of services, characteristics and attributes used in the attribute server (e.g., volume attributes and service). The GATT provides interfaces for discovering, reading, writing, and indicating of service characteristics and attributes. GATT is used on Bluetooth Low Energy (LE) devices for LE profile service discovery. More information regarding GATT can be found in the Bluetooth Core Specification 5.2, which has an adoption date of Dec. 31, 2019 and is available at https://www.bluetooth.com/specifications/bluetooth-core-specification/, all of which is incorporated herein by reference.

Also, the GATT 220 can provide volume service to other devices (e.g., client devices). Volume service can include providing states of volume controls or settings of the hearing device and/or providing notification of changes to the states or settings of volume for the hearing device. Specifically, if a hearing device establishes a wireless connection with another device (e.g., via Bluetooth Low Energy), the other device can access the GATT 220 of the hearing device and the GATT 220 can provide information about the hearing device, including volume information and/or settings.

The volume determiner 225 determines a volume setting or parameter for an output signal of the hearing device. The volume determiner 225 can receive volume information from the GATT 220, from a wireless communication device, or another input from the hearing device user. The volume determiner 225 can receive ambient sound level and external sound level information from a wireless communication device and use this information to set the volume or levels of an output signal for the hearing device 103.

In some implementations, the volume determiner 225 can receive volume control signals or volume settings from a remote control or mobile application. The hearing device may also receive external sound signals from a wireless communication or multiple wireless communication devices. In some implementations, the wireless communication device and the remote control device are different devices such that the user can control volume levels with one device and receive an external sound signal from another device. The volume determiner 225 can determine how to balance the volume control of the hearing device based on these received signals from external devices, programming, and/or settings of the hearing device (e.g., input from the hearing device user directly on the hearing device via a slider, dial, button).

The processor 230 can include special-purpose hardware such as application specific integrated circuits (ASICs), programmable logic devices (PLDs), field-programmable gate arrays (FPGAs), programmable circuitry (e.g., one or more microprocessors microcontrollers), appropriately programmed with software and/or computer code, or a combination of special purpose hardware and programmable circuitry. The hearing device 103 can have a separate DSP to process audio signals. Yet, in some implementations, the processor 230 can be combined with the DSP in a single unit, wherein the processor 230 can process audio signals. Also, in some implementations, the hearing device 103 can have multiple processors, where the multiple processors can be physically coupled to the hearing device 103 and configured to communicate with each other.

The battery 235 can be a rechargeable battery (e.g., lithium ion battery) or a non-rechargeable battery (e.g., Zinc-Air) and the battery 235 can provide electrical power to the hearing device 103 or its components. Because some rechargeable batteries are composed of different material compared to non-rechargeable batteries, some rechargeable batteries have different magnetic or electrical properties compared to non-rechargeable batteries.

The transceiver 240 communicates with the antenna 245 to transmit or receive information. The antenna 245 is configured to operation in unlicensed bands such as Industrial, Scientific, and Medical Band (ISM)) using a frequency of 2.4 GHz. The antenna 245 can also be configured to operation in other frequency bands such as 5 GHz, 5 MHz, 10 MHz, or other unlicensed or licensed bands.

The sensor 250 can be a pressure sensor, an optical sensor, a temperature sensor, capacitive sensor (e.g., for touch detection), mechanical sensor (e.g., for touch detection), a magnetic sensor (e.g., proximity detection), an accelerometer, or other sensor configured to fit in or around a hearing device.

The transducer 255 is a component that converts energy from one form to another. A transducer 255 can be a speaker, actuator, coil, or other component configured to convert energy from one form to another. For example, the transducer 255 can be a coil for a cochlear device that converts electrical signals or energy into magnetic signals or energy (or vice versa).

The microphone 260 is configured to capture sound and provide an audio signal of the captured sound to the processor 230. The processor 230 can modify the sound (e.g., in a digital signal processor (DSP)) and provide the modified sound to a user of the hearing device 103. Although a single microphone 260 is shown in FIG. 2, the hearing device 103 can have more than one microphone. For example, the hearing device 103 can have an inner microphone, which is positioned near or in an ear canal, and an outer microphone, which is positioned on the outside of an ear. As another example, the hearing device 103 can have two microphones, and the hearing device 103 can use both microphone to perform beam forming operations. In such an example, the processor 230 can include a DSP configured to perform beam forming operations.

Figure 3:
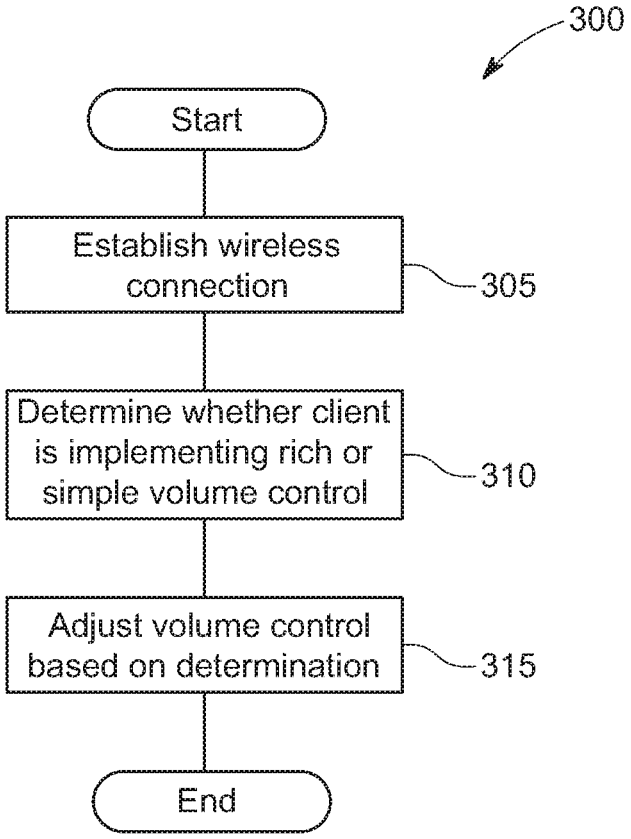
FIG. 3 is a block flow diagram of a process to control volume of a hearing device in accordance with some implementations of the disclosed technology.

FIG. 3 illustrates a block flow diagram for a process 300 for providing volume control for a hearing device. A hearing device or a computer device can execute the process 300. In some implementations, part of the process 300 may be carried out on more than one device. The process 300 begins with an establish wireless connection operation 305 and continues with operation 310.

At the establish wireless connection operation 305, a hearing device and a wireless communication device establish a wireless communication connection (e.g., a server hearing device connects to a client device such as a remote control, audio player, TV streamer, or mobile phone). The wireless connection can be based on Bluetooth Low Energy™. Establishing a wireless connection can include the hearing device and the wireless communication device looking for each other within a range (e.g., the range of Bluetooth), the two devices finding each other (or one device finding the other device), pairing (e.g., prompting for passkey, exchanging passkey, sharing passkey, and verifying passkey is correct), and then communicating using a secure Bluetooth connection. Although Bluetooth™ is one possible wireless connection type, other wireless communication connections or protocols can be used to establish the wireless connection.

At determine operation 310, the hearing device determines whether the wireless communication device (e.g., client device) is implementing a rich or simple volume control. The rich volume control is associated with an ability of the wireless communication client device to provide an ambient sound level and an external sound level associated with volume of a hearing device output signal. For example, the rich volume control can be associated with a smart phone that has an ability that allows a hearing device user to adjust both an ambient sound level of the hearing device and an external sound level of an external signal at the hearing device (e.g., levels 1-5, where 1 is low and 5 is high). The wireless communication can adjust these levels automatically based on settings or programming. Alternatively or additionally, the wireless communication device can adjust the ambient sound level and/or external sound level based on input from the hearing device user via a user interface (e.g., moving a dial, moving a slider, or manually inputting a level).

The hearing device can determine that the client device is implementing rich volume control based on determining that the client device has registered for notification of volume state changes for the hearing device, read volume state settings for the hearing device and/or registered for notification of the ambient sound level and external sound level. Alternatively, determining that the client device is implementing the simple volume control can be based on determining that the client device has not registered for the notification of volume state changes for the hearing device, has not read the volume state settings for the hearing device, and/or has not registered for notification of the ambient sound level and external sound level. For example, after the wireless communication device and the hearing device have wirelessly connected (operation 305), the hearing device can receive a request from the wireless communication device that it was to receive notification of any state changes in the volume settings of the hearing device. As shown in FIG. 2, this information can be shared via the GATT. Alternatively, the hearing device can determine that the wireless communication device is reading specific volume state settings from the hearing device memory such as ambient sound level and/or external sound level.

The simple volume control is associated with an ability of the wireless communication device (e.g., client device) to adjust only a master volume level associated with the volume of the hearing device output signal. The hearing device can determine that the wireless communication device is implementing simple volume control based on determining that the client device has not registered for the notification of volume state changes for the hearing device or has not read the volume state settings for the hearing device. More specifically, if the wireless communication device is just sharing master volume settings and not reading, accessing, or otherwise using specific volume settings related to ambient and/or external sound levels, it is presumed that the wireless communication device is implementing a simple volume control that generally only relates to the master volume control (e.g., output level or amplification of signal output at hearing device).

At adjust volume control operation 315, the hearing device adjust the output signal of the hearing device based on the volume control information determined from operation 310. Adjusting the output signal can include modifying the ambient sound level, the external signal level, and/or the master volume level (e.g., amplification of the master volume). For example, if the hearing device determines that the wireless communication device is simple, the hearing device can decrease the ambient sound level from 5 (or 50%) to 4 (or 40%) and increase the external sound level from 5 (e.g., 50%) to 6 (e.g., 60%) in response to determining that the hearing device wants the external sound to be louder or easier to understand.

As another example, if the hearing device determines that the wireless communication device is rich, it can receive the ambient sound level and external sound level from the wireless communication device, and modify only the master volume of an output signal for the hearing device. The master volume generally controls the amplification of the output signal such that amplifying makes it louder (both ambient sound an external sound).

Aspects and implementations of the process 300 of the disclosure have been disclosed in the general context of various steps and operations. A variety of these steps and operations may be performed by hardware components or may be embodied in computer-executable instructions, which may be used to cause a general-purpose or special-purpose processor (e.g., in a computer, server, or other computing device) programmed with the instructions to perform the steps or operations. For example, the steps or operations may be performed by a combination of hardware, software, and/or firmware such with a wireless communication device or a hearing device. The computer-executable instructions can be stored on a non-transitory computer-readable medium, which when executed by a processor or hearing device cause the hearing device to perform the process 300.

Figure 4:
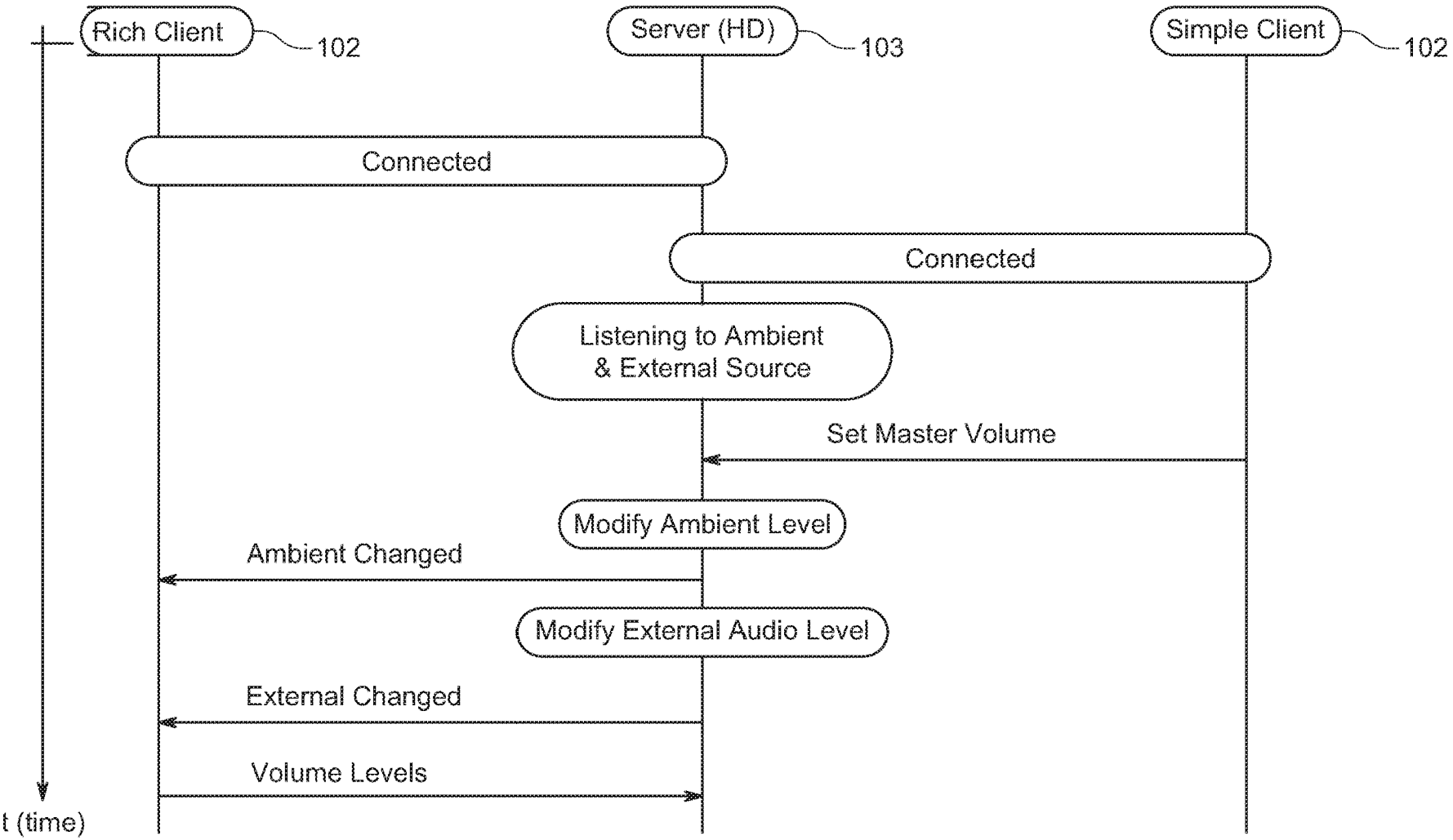
FIG. 4 schematic diagram illustrating the communication flow between a server (e.g., hearing device from FIG. 1) and two client devices (e.g., wireless communication devices from FIG. 2) in accordance with some implementations of the disclosed technology.

FIG. 4 schematic diagram illustrating the communication flow between a server (e.g., hearing device from FIG. 1) and two wireless communication devices (e.g., two client devices). One wireless communication device (see left side of FIG. 4) is a rich client and one wireless communication device is a simple client (see right side of FIG. 4). The wireless communication device can be the wireless communication device 102 from FIG. 1. Rich client refers to a device that is configured to implement rich volume control and simple client refers to a client device that is configured to implement simple volume control. The middle of FIG. 4 illustrates a server (hearing device) such as hearing device 103 from FIG. 1. And on the left side of FIG. 4 is a graph showing how time progresses (at the top is time zero and time proceeds on moving down the graph). Although the server hearing device 103 is shown as connecting to two client wireless communication devices 102, it can connect to a single client wireless communication device 102.

At the top of FIG. 4, the rich client wireless communication device 102 or the simple client wireless communication device 102 establishes a wireless communication with the server hearing device 103. The wireless connection can be a Bluetooth™ Low Energy connection. With the wireless connection the client device can be a client and the server can be a server such that there is a client-server relationship formed. After establishing a wireless connection, the server hearing device 103 can listen to ambient and external sources. An ambient source can be the microphone located locally on the server hearing device 103. External sound sources can be the rich client or simple client or even another wireless communication device. For example, the rich client can be a remote control for volume and a wireless communication device can be a speaker that transmits an external audio signal wirelessly to the server hearing device 103.

As shown on the right side of FIG. 4, the simple client only transmits a set value or information for the master volume control. As explained in FIGS. 2 and 3, the hearing device can further modify the audio signal received from the simple client to adjust ambient sound level and/or external sound levels. As shown on the left side of FIG. 4, the server hearing device 103 can provide volume service to rich client device 102. When the server hearing device 103 modifies the ambient level, it can transmit this information as an "ambient changed" signal to the rich client device 103. When the server hearing device 103 modifies the external audio level, it can transmit this information as an "external changed" signal to the rich client device 103. These signals indicate that the volume levels or settings of the hearing device changed (e.g., increased or decreased) and can include the actual new value. The rich client wireless communication device 102 can receive these communications and update its local volume settings. Optionally, the rich client wireless communication device 102 can transmit volume levels (e.g., ambient levels or external audio levels) to the server hearing device 103. The server hearing device 103 can use these levels to adjust the hearing device output signal.

The phrases "in some implementations," "according to some implementations," "in the implementations shown," "in other implementations," and generally mean a feature, structure, or characteristic following the phrase is included in at least one implementation of the disclosure, and may be included in more than one implementation. In addition, such phrases do not necessarily refer to the same implementations or different implementations.

The techniques introduced here can be embodied as special-purpose hardware (e.g., circuitry), as programmable circuitry appropriately programmed with software or firmware, or as a combination of special-purpose and programmable circuitry. Hence, implementations may include a machine-readable medium having stored thereon instructions which may be used to program a computer (or other electronic devices) to perform a process. The machine-readable medium may include, but is not limited to, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. In some implementations, the machine-readable medium is non-transitory computer readable medium, where in non-transitory excludes a propagating signal.

The above detailed description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize. For example, while processes or blocks are presented in an order, alternative implementations may perform routines having steps, or employ systems having blocks, in a different order, and some processes or blocks may be deleted, moved, added, subdivided, combined, or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc. As another example, "A or B" can be only A, only B, or A and B.

I claim:

1. A method to operate a hearing device, the method comprising:

establishing a wireless communication connection between a hearing device and a client device;

providing volume control service for the hearing device to the client device;

determining, at the hearing device, whether the client device is implementing rich or simple volume control based on communication with the client device, wherein the rich volume control is associated with an ability of the client device to provide an ambient sound level and an external sound level associated with volume of a hearing device output signal, and wherein the simple volume control is associated with an ability of the client device to adjust only a master volume level associated with the volume of the hearing device output signal;

in response to determining the client device is implementing the rich volume control, modifying, only the master volume at the hearing device based on a master volume level provided by the client device; or in response to determining the client device is implementing the simple volume control, modifying a balance of ambient sound and external sound for the hearing device output signal based at least partially on the master volume level provided by the client device.

2. The method of claim 1, wherein the determining whether the client device is implementing the rich or the simple volume control further comprises the following operations:

determining that the client device is implementing the rich volume control based on determining that the client device has registered for notification of volume state changes for the hearing device, read volume state settings for the hearing device, and/or registered for notification of the ambient sound level and external sound level; or determining that the client device is implementing the simple volume control based on determining that the client device has not registered for the notification of volume state changes for the hearing device, has not read the volume state settings for the hearing device, and/or has not registered for notification of the ambient sound level and external sound level.

3. The method of claim 1, wherein the external sound level is associated with a signal generated at the client device and transmitted to the hearing device or received by the client device and transmitted to the hearing device.

4. The method of claim 1, wherein the ambient sound level is associated with a signal generated at a microphone of the hearing device or received by the microphone of the hearing device.

5. The method of claim 1, the method further comprises:

determining that the client device has changed from implementing the simple volume control to implementing the rich volume control based on communication with the client device; or determining that the client device has changed from implementing the rich volume control to the simple volume control based on communication with the client device.

6. The method of claim 1, wherein the determining that the client device has changed from implementing the simple volume control to the implementing the rich volume control or vice versa further comprising:

determining that the client device is implementing the rich volume control based determining that the client device has registered for notification of volume state changes for the hearing device or read volume state settings for the hearing device; or determining that the client device is implementing the simple volume control based determining that the client device has not registered for the notification of volume state changes for the hearing device or has not read the volume state settings for the hearing device.

7. The method of claim 1, the method further comprising:

providing an output signal based on the volume control signals for the client device implementing the simple volume control or implementing the rich volume control.

8. The method of claim 1, wherein the client device is at least one of the following:

a mobile phone;

a computer;

a remote control;

an audio device;

a TV signal transmitter;
a watch;
a wireless communication device;
another hearing device; or
a speaker.

9. The method of claim 1, further comprising:
receiving, at the hearing device, an external sound signal from an audio source device.

10. A hearing device, the hearing device comprising:
a processor configured to receive an external audio signal from a client device;
a microphone configured to provide an ambient signal;
a memory storing instructions that, when executed by the processor, cause the hearing device to perform the following operations:
determine, at the hearing device, whether the client device is implementing rich or simple volume control based on communication with the client device,
wherein the rich volume control is associated with an ability of the client device to provide an ambient sound level and an external sound level associated with volume of a hearing device output signal, and
wherein the simple volume control is associated with an ability of the client device to adjust only a master volume level associated with the volume of the hearing device output signal;
if it is determined that the client device is implementing the rich volume control, modify, only the master volume at the hearing device; or
if it is determined that the client device is implementing the simple volume control, modify a balance of ambient sound and external sound for the hearing device output signal based at least partially on the master volume level provided by the client device.

11. The hearing device of claim 10, wherein the hearing device further comprises a transceiver configured to wireless communicate with the client device.

12. The hearing device of claim 10, wherein the determine whether the client device is rich or simple further comprises the following operations:
determining that the client device is implementing the rich volume control based on determining that the client device has registered for notification of volume state changes for the hearing device or read volume state settings for the hearing device; or
determining that the client device is implementing the simple volume control based on determining that the client device has not registered for the notification of volume state changes for the hearing device or has not read the volume state settings for the hearing device.

13. The hearing device of claim 10, wherein the client device is at least one of the following:
a mobile phone;
a computer;
an audio device;
a TV signal transmitter;
a watch;
a wireless communication device;
another hearing device; or
a speaker.

14. The hearing device of claim 10, wherein the operations further comprise:
determine that the hearing device user has tinnitus and adjusting or not adjusting the external sound level or ambient sound level based on this determination; and/or
adjusting volume settings, ambient sound level, external sound level, or a tinnitus masking signal based on communication or volume signals from the client device.

15. The hearing device of claim 10, wherein the establishing the wireless communication is associated with BLUETOOTH LOW ENERGY™.

16. The hearing device of claim 10, wherein the operations further comprise:
provide an output signal based on the volume control signals for the client device implementing the simple volume control or implementing the rich volume control.

17. The hearing device of claim 10, wherein the hearing device further comprises:
receive an external audio signal from a wireless communication device, wherein the wireless communication is different from the device that sets the external sound level.

18. A non-transitory computer-readable medium storing instructions, that when executed by a processor of a hearing device cause the hearing device to perform operations, the operations comprise:
determining, at the hearing device, whether a client device is implementing rich or simple volume control based on communication with the client device,
wherein the rich volume control is associated with an ability of the client device to provide an ambient sound level and an external sound level associated with volume of a hearing device output signal, and
wherein the simple volume control is associated with an ability of the client device to adjust only a master volume level associated with the volume of the hearing device output signal;
in response to determining the client device is implementing the rich volume control, modifying, only the master volume at the hearing device based on communications from the client device based on hearing device volume settings; or
in response to determining the client device is implementing the simple volume control, modifying a balance of ambient sound and external sound for the hearing device output signal based at least partially on the master volume level provided by the client device.

19. The non-transitory computer-readable medium of claim 18, wherein the threshold is first threshold, wherein the operations further comprise:
determining that the client device is implementing the rich volume control based determining that the client device has registered for notification of volume state changes for the hearing device or read volume state settings for the hearing device; or
determining that the client device is implementing the simple volume control based determining that the client device has not registered for the notification of volume state changes for the hearing device or has not read the volume state settings for the hearing device.

20. The non-transitory computer-readable medium of claim 18, wherein the operations further comprise:
determining that the client device has changed from implementing the simple volume control to implementing the rich volume control based on communication with the client device; or
determining that the client device has changed from implementing the rich volume control to the rich volume control based on communication with the client device.

* * * * *